US005721080A

United States Patent [19]

Terrell et al.

[11] Patent Number: 5,721,080

[45] Date of Patent: Feb. 24, 1998

[54] ELECTROPHOTOGRAPHIC MATERIAL CONTAINING PARTICULAR PHTHALOCYANINES

[75] Inventors: David Terrell, Lint; Stefaan De Meutter, Antwerp, both of Belgium; Bernd Kaletta, Langenfeld, Germany

[73] Assignee: AGFA-GEVAERT, N.V., Mortsel, Belgium

[21] Appl. No.: 771,284

[22] Filed: Dec. 20, 1996

Related U.S. Application Data

[63] Continuation of Ser. No. 341,599, Nov. 21, 1994, abandoned.

[30] Foreign Application Priority Data

Jun. 4, 1992 [EP] European Pat. Off. ..... 92201618

[51] Int. Cl.$^6$ ..... G03G 5/047

[52] U.S. Cl. ..... 430/58; 430/78; 430/31

[58] Field of Search ..... 430/78, 58, 31

[56] References Cited

U.S. PATENT DOCUMENTS

| | | | |
|---|---|---|---|
| 3,357,989 | 12/1967 | Byrne et al. | 430/78 |
| 3,816,118 | 6/1974 | Byrne | 430/78 |
| 4,507,374 | 3/1985 | Kakuta et al. | 430/58 |
| 4,546,059 | 10/1985 | Ong et al. | 430/58 |
| 4,547,447 | 10/1985 | Ueda | 430/78 |
| 4,609,602 | 9/1986 | Ong et al. | 430/58 |
| 4,800,145 | 1/1989 | Nelson et al. | 430/58 |
| 5,134,048 | 7/1992 | Terrell et al. | 430/78 |
| 5,312,706 | 5/1994 | Springett | 430/78 |

OTHER PUBLICATIONS

Diamond, Arthur S. Handbook of Imaging Materials. New York: Marcel–Dekker, Inc. pp. 427–436. 1991.

*Primary Examiner*—Christopher D. Rodee
*Attorney, Agent, or Firm*—Breiner & Breiner

[57] ABSTRACT

An electrophotographic recording material comprising a conductive support and a photosensitive layer containing a photoconductive crystalline substituted metal-free phthalocyanine compound and/or mixed crystals of said substituted metal-free phthalocyanine compounds with unsubstituted metal-free phthalocyanine, wherein said substantial metal-free phthalocyanine compound represented by general formula (I) defined herein is substituted with alkyl or alkoxy.

16 Claims, 7 Drawing Sheets

ELECTROPHOTOGRAPHIC MATERIAL CONTAINING PARTICULAR PHTHALOCYANINES

This is a continuation of application Ser. No. 08/341,599 filed on Nov. 21, 1994 now abandoned.

FIELD OF THE INVENTION

The present invention relates to photosensitive recording materials suitable for use in electrophotography.

BACKGROUND OF THE INVENTION

In electrophotography photoconductive materials are used to form a latent electrostatic charge image that is developable with finely divided colouring material, called toner.

The developed image can then be permanently affixed to the photoconductive recording material, e.g. a photoconductive zinc oxide-binder layer, or transferred from the photoconductor layer, e.g. a selenium or selenium alloy layer, onto a receptor material, e.g. plain paper and fixed thereon. In electrophotographic copying and printing systems with toner transfer to a receptor material the photoconductive recording material is reusable. In order to permit rapid multiple printing or copying, a photoconductor layer has to be used that rapidly loses its charge on photo-exposure and and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

A further important property which determines the suitability of a particular photoconductive material for electrophotographic copying is its photosensitivity, which must be sufficiently high for use in copying apparatuses operating with the fairly low intensity light reflected from the original. Commercial usefulness also requires that the photoconductive layer has a spectral sensitivity that matches the spectral intensity distribution of the light source e.g. a laser or a lamp. This enables, in the case of a white light source, the reproduction of all the colours in balance.

Known photoconductive recording materials exist in different configurations with one or more "active" layers coated on a conducting substrate and include optionally an outermost protective layer. By "active" layer is meant a layer that plays a role in the formation of the electrostatic charge image. Such a layer may be the layer responsible for charge carrier generation, charge carrier transport or both. Such layers may have a homogeneous structure or heterogeneous structure.

Examples of active layers in said photoconductive recording material having a homogeneous structure are layers made of vacuum-deposited photoconductive selenium, doped silicon, selenium alloys and homogeneous photoconducting polymer coatings, e.g. of poly(vinylcarbazole) or polymeric binder(s) molecularly doped with an electron (negative charge carrier) transporting compound or a hole (positive charge carrier) transporting compound such as particular hydrazones, amines and heteroaromatic compounds sensitized by a dissolved dye, so that in said layers both charge carrier generation and charge carrier transport take place.

Examples of active layers in said photoconductive recording material having a heterogeneous structure are layers of one or more photosensitive organic or inorganic charge generating pigment particles dispersed in a polymer binder or polymer binder mixture in the presence optionally of (a) molecularly dispersed charge transport compound(s), so that the recording layer may exhibit only charge carrier generation properties or both charge carrier generation and charge transport properties.

According to an embodiment that may offer photoconductive recording materials with particularly low fatigue a charge generating and charge transporting layer are combined in contiguous relationship. Layers which serve only for the charge transport of charge generated in an adjacent charge generating layer are e.g. plasma-deposited inorganic layers, photoconducting polymer layers, e.g. on the basis of poly(N-vinylcarbazole) or layers made of low molecular weight organic compounds molecularly distributed in a polymer binder or binder mixture.

In order to form a photoconductive two layer-system with high photosensitivity to the incident light efficient charge generating substances are required that operate in conjunction with efficient charge transport substances.

Examples of preferred polymeric positive hole charge carrier transporting substances are poly(N-vinylcarbazole), N-vinylcarbazole copolymers, polyvinyl anthracene and the condensation products of an aldehyde with two or more 1,2-dihydroquinoline molecules as described e.g. in U.S. Pat. No. 5,043,238.

Preferred non-polymeric materials for positive charge transport are:

hydrazones e.g. a p-diethylaminobenzaldehyde diphenyl hydrazone as described in U.S. Pat. No. 4,150,987; and other hydrazones described in U.S. Pat. No. 4,423,129; U.S. Pat. No. 4,278,747, U.S. Pat. No. 4,365,014, EP 448,843 A and EP 452,569 A, e.g. T 191 from Takasago having the following structure:

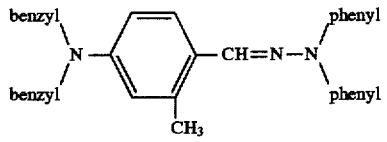

b) aromatic amines e.g. N,N'-diphenyl, N,N-bis-m-tolyl benzidine as described in U.S. Pat. 4,265,990, tris(p-tolyl)amine as described in U.S. Pat. 3,180,730 :

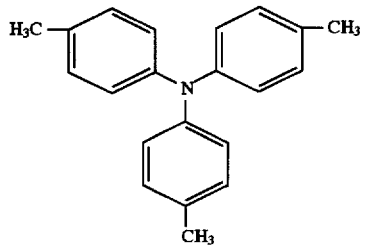

1,3,5-tris(aminophenyl)benzenes as described in U.S. Pat No. 4,923,774; 3,5 diarylaniline derivatives as described in EP 534,514 A and triphenyloxazole derivatives as described in EP 534,005 A;

c) heteroaromatic compounds e.g. N-(p-aminophenyl) carbazoles as described in U.S. Pat. No. 3,912,509 and dihydroquinoline compounds as described in U.S. Pat.

No. 3,832,171, U.S. Pat. No. 3,830,647, U.S. Pat. No. 4,943,502, U.S. Pat. No. 5,043,238, EP 452,569 A and EP 462,327 A e.g.

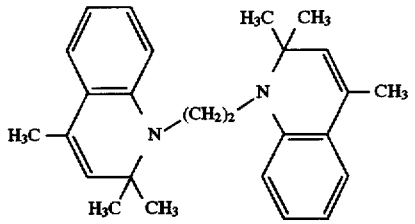

d) triphenylmethane derivatives as described for example in U.S. Pat. No. 4,265,990;

e) pyrazoline derivatives as described for example in U.S. Pat. No. 3,837,851;

f) stilbene derivatives as described for example in Japanese Laid Open Patent Application (JL-OP) 198,043/83.

Preferred non-polymeric materials for negative charge transport are :

a) dicyanomethylene and cyanoalkoxycarbonyl methylene condensates with aromatic ketones such as 9-dicyanomethylene-2,4,7-trinitro-fluorenone (DTF); 1-dicyanomethylene-indan-1-ones as described in EP 537,808 A with the formula:

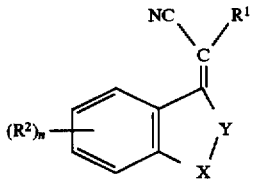

wherein $R^1$ and $R^2$ have the same meaning as described in said published EP application; compounds with the formula:

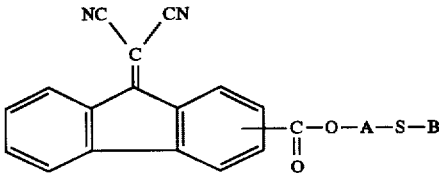

wherein A is a spacer linkage selected from the group consisting of an alkylene group including a substituted alkylene group, an arylene group including a substituted arylene group; S is sulphur, and B is a member selected from the group consisting of an alkyl group including a substituted alkyl group, and an aryl group including a substituted aryl group as disclosed e.g. in U.S. Pat. No. 4,546,059 such as :

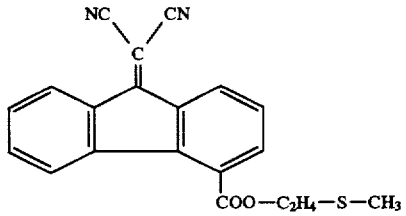

and 4-dicyanomethylene 1,1-dioxo-thiopyran-4-one derivatives as disclosed in U.S. Pat. No. 4,514,481 and U.S. Pat. No. 4,968,813 e.g.

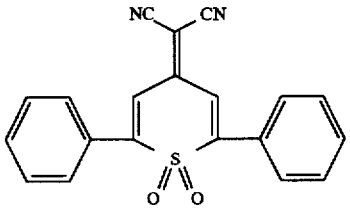

and

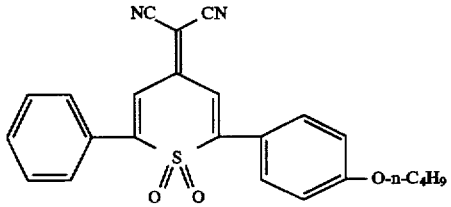

b) derivatives of malononitrile dimers as described in EP 534,004 A;

c) nitrated fluorenones such as 2,4,7-trinitrofluorenone and 2,4,5, 7-tetranitrofluorenone;

d) dicyanofluorene carboxylate derivatives as described in U.S. Pat. No. 4,562,132;

e) 1,1,2-tricyanoethylene derivatives. Useful charge carrier generating pigments (CCM's) belong to one of the following classes:

a) perylimides, e.g. C.I. 71 130 (C.I=Colour Index) described in DBP 2 237 539;

b) polynuclear quinones, e.g. anthanthrones such as C.I. 59 300 described in DBP 2 237 678;

c) quinacridones, e.g. C.I. 46 500 described in DBP 2 237 679;

d) naphthalene 1, 4,5, 8-tetracarboxylic acid derived pigments including the perinones, e.g. Orange GR, C.I. 71 105 described in DBP 2 239 923;

e) tetrabenzoporphyrins and tetranaphthaloporphyrins, e.g. $H_2$-phthalocyanine in X-crystal form (X—$H_2$Pc) described in U.S. Pat. No. 3,357,989, metal phthalocyanines, e.g. CuPc C.I. 74 160 described in DBP 2 239 924, indium phthalocyanine described in U.S. Pat. No. 4,713,312 and tetrabenzoporphyrins described in EP 428,214 A; and naphthalocyanines having siloxy groups bonded to the central metal silicon described in published EP-A 243,205;

f) indigo- and thioindigo dyes, e.g. Pigment Red 88, C.I. 73 312 described in DBP 2 237 680;

g) benzothioxanthene derivatives as described e.g. in Deutsches Auslegungsschrift (DAS) 2 355 075;

h) perylene 3,4, 9, 10-tetracarboxylic acid derived pigments including condensation products with o-diamines as described e.g. in DAS 2 314 051;

i) polyazo-pigments including bisazo-, trisazo- and tetrakisazo-pigments, e.g. Chlordiane Blue C.I. 21 180 described in DAS 2 635 887, trisazo-pigments, e.g. as described in U.S. Pat. No. 4,990,421 and bisazo-pigments described in Deutches Offenlegungsschrift (DOS) 2 919 791, DOS 3 026 653 and DOS 3 032 117;

j) squarylium dyes as described e.g. in DA5 2 401 220;

k) polymethine dyes;

l) dyes containing quinazoline groups, e.g. as described in GB-P 1,416,602 according to the following general formula:

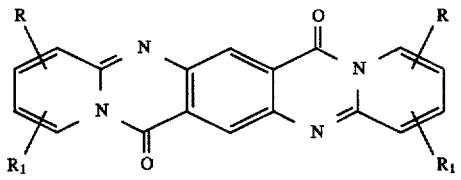

in which R and $R_1$ are either identical or different and denote hydrogen, $C_1$–$C_4$ alkyl, alkoxy, halogen, nitro or hydroxyl or together denote a fused aromatic ring system;

m) triarylmethane dyes;

n) dyes containing 1,5 diamino-anthraquinone groups; and o) inorganic photoconducting pigments e.g. Se or Se alloys, $As_2Se_3$, $TiO_2$, ZnO, CdS, etc.

Most of the patent literature over charge generating materials (CGM's) is devoted to CGM's for use with positive charge transporting charge transporting layers (p-CTL's). However, the recent development of efficient electron transport compounds with sufficient solubility in both the casting solvent and the CTL-binder, as described e.g. in EP 537,808 A, has enabled efficient negative charge transporting charge transporting layers (n-CTL's) to be produced.

These require efficient CGM's, which can inject negatieve charge (electrons) into these n-CTL's. Tetrabenzoporphyrin CGM's are known to be able to inject negative or positive charge into n-CTL's and p-CTL's respectively. However, a major problem with tetrabenzoporphyrin pigments is impurities incorporated during their production. These are either byproducts of the ring closure process due to the ring closure occurring relatively inefficiently as is the case of the metal-free triazatetrabenzoporphyrin pigments described in EP 428 214A or are degradation products introduced by acid pasting during the conversion of β-morphology pigment to α-morphology pigment. Once present these impurities are difficult or impossible to remove. The presence of these impurities increases the dark conduction of the double layer photoreceptors incorporating the CGM's in some cases sufficiently to affect adversely their chargeability.

In U.S. Pat. No. 3,816,118 an electrophotographic material is disclosed comprising phthalocyanine pigment particles dispersed in a binder material and a spectral sensitizing agent for said phthalocyanine pigment, said phthalocyanine particles being present in said binder in an amount up to about 50 percent by weight and said binder having a resistivity greater than about $10^{10}$ ohm/cm. A secondary claim restricts said phthalocyanine to "the group consisting of beta-formphthalocyanine and X-form phthalocyanine and mixtures thereof". According to said U.S. patent specification these phthalocyanine pigments can be substituted or unsubstituted. In said U.S. Patent the X-ray diffraction spectra [Bragg Angle (2θ) versus intensity] of alpha, beta, gamma and X-formphthalocyanine are given. The spectra for the X-form has peaks at Bragg angles of about 17.3 and 22.3, which exist in none of the α, β and γ spectra. The preparation of unsubstituted X-form metal-free phthalocyanine is given also in said U.S. Pat. No. 3,816,118. Phthalocyanine pigments in the morphological X-form have a broadened spectral sensitivity range in comparison with α- or β-form (see FIG. 1) and offer an improved photosensitivity, see e.g. the spectral sensitivity characteristic of a photoconductor with X-metal-free phthalocyanine (FASTOGEN BLUE 8120B from Dainippon Ink and Chemicals Inc.) in FIG. 1.

In U.S. Pat. No. 4,443,528 a photoconductive recording material is disclosed comprising a phthalocyanine and a phthalocyanine derivative in which the phthalocyanine molecule has benzene nuclei substituted with at least one member selected from nitro groups and cyano groups". In a secondary claim "said phthalocyanine has a crystal form selected from the group consisting of α and β forms". In the examples of said U.S. Patent the following "phthalocyanine derivatives" are mentioned: tetranitro copper phthalocyanine, mononitro copper phthalocyanine, dinitro copper phthalocyanine, trinitro copper phthalocyanine, tetracyano copper phthalocyanine and tetracyano cobalt phthalocyanine all without specifying the positions of the phthalocyanine substituents, except for the compound of Example 10 the starting ingredient of which was 4-nitrophthalimide.

OBJECTS AND SUMMARY OF THE INVENTION

It is an object of the present invention to provide an electrophotographic recording material comprising a conductive support and a photosensitive layer containing a photoconductive substituted metal-free phthalocyanine compound having high charge generating efficiency and/or mixed crystals of said substituted metal-free phthalocyanine compounds with unsubstituted metal-free phthalocyanine compounds.

It is another object of the present invention to provide an electrophotographic recording material comprising a conductive support and a charge transporting layer in contiguous relationship with a charge generating layer containing a photoconductive substituted metal-free phthalocyanine compound and/or mixed crystals of said substituted metal-free phthalocyanine compounds with unsubstituted metal-free phthalocyanine compounds having a high positive hole generating capacity, i.e. high p-type charge generating capacity and/or a high electron generating capacity, i.e. high n-type charge generating capacity, combined with good cyclic behaviour in repetitive use.

It is a further object of the present invention to provide an electrophotographic recording material comprising a conductive support and a photosensitive layer with improved photosensitivity in a wavelength range above 550 nm.

It is a still further object of the present invention to provide an electrophotographic recording material comprising a conductive support and a charge transporting layer in contiguous relationship with a charge generating layer with improved photosensitivity in a wavelength range above 550 nm.

Further objects and advantages of the present invention will appear from the further description and examples.

In accordance with the present invention an electrophotographic recording material is provided comprising a conductive support and a photosensitive recording layer having charge generating capacity by photo-exposure and containing as photoconductive pigment a photoconductive crystalline substituted metal-free phthalocyanine compound and/or mixed crystal pigment of said substituted metal-free phthalocyanine compound with an unsubstituted metal-free phthalocyanine, characterized in that said substituted metal-free phthalocyanine compound is represented by following general formula (I):

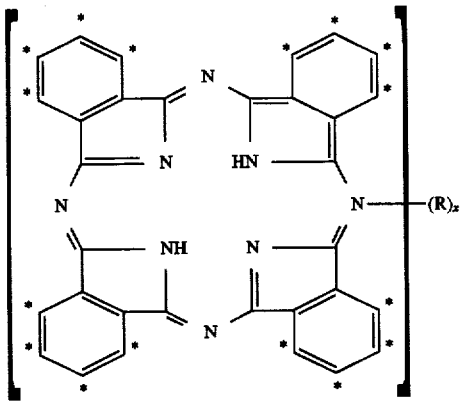

(I)

wherein:

R represents a substituent selected from the group consisting of an alkyl group and an alkoxy group, said substituent being in ortho- or meta-position on at least one 6-membered ring in the phthalocyanine structure, each substituted 6-membered ring being only mono-substituted the possible substitution positions being marked by asterisk (*), and x is an integer 1, 2, 3 or 4.

BRIEF DESCRIPTION OF THE DRAWINGS

FIG. 1 shows the spectral sensitivity characteristic of a photoconductive recording material containing X-metal-free phthalocyanine (FASTOGEN BLUE 8120B from Dainippon Ink and Chemicals Inc.) in which the relative sensitivity (RS) is plotted against the wavelength (λ) in nm of the incident light from a monochromator. RS is expressed by the incident light exposure in $mJ/m^2$ required to reduce the charging level to half its initial value relative to that required at the wavelength at which maximum sensitivity was observed.

FIG. 2 shows the dependence of pigment modification (α, X, β or mixtures thereof), as identified by light absorption and X-ray diffraction spectra and produced by treating finely divided α-metal-free phthalocyanine pigments with refluxing α-methylnaphthalene for 24 hours, upon the molar percentage (mole %) of metal-free 1-methylphthalocyanine (Cpd 1) in the crystal or mixed crystal to unsubstitutedmetal-free phthalocyanine ($H_2Pc$).

FIG. 3 shows the dependence of pigment modification (α, X, β or mixtures thereof), as identified by light absorption and X-ray diffraction spectra and produced by treating finely divided α-metal-free phthalocyanine pigments with refluxing α-methylnaphthalene for 24 hours, upon the molar percentage (mole %) of metal-free 2-methylphthalocyanine (Cpd 2) in the crystal or mixed crystal to unsubstituted metal-free phthalocyanine ($H_2Pc$).

FIG. 4 shows the dependence of the pigment modification: α, X, β or mixtures thereof, as identified by absorption and X-ray diffraction spectra and produced by treating finely divided α-metal-free phthalocyanine pigments with refluxing α-methylnaphthalene for 24 hours, upon the molar percentage (mole %) of metal-free 1-methoxyphthalocyanine (Cpd 3) in the crystal or mixed crystal to unsubstituted metal-free phthalocyanine (H2Pc).

FIG. 5 gives the absorption spectra as the dependence of absorbance (A) upon wavelength (λ) for charge generating layers cast from dispersions with a 1:1 weight ratio of charge generating pigment to polycarbonate resin binder MAKROLON CD 2000 (tradename) in methylene chloride prepared by 40 hours mixing in a ball mill for X-metal-free phthalocyanine (FASTOGEN BLUE 8120B from Dainippon Ink and Chemicals Inc.) before (FIG. 5*a*) and after (FIG. 5*b*) heating at 250° C. for 16 hours.

FIG. 6 shows the X-ray diffraction spectra as intensity (I) versus the Bragg angle (2θ) for an X-metal-free phthalocyanine sold under the tradename FASTOGEN BLUE 8120B from Dainippon Ink and Chemicals Inc.) before (FIG. 6*a*) and after (FIG. 6*b*) heating at 250° C. for 16 hours.

DETAILED DESCRIPTION OF THE INVENTION

Figure 1:
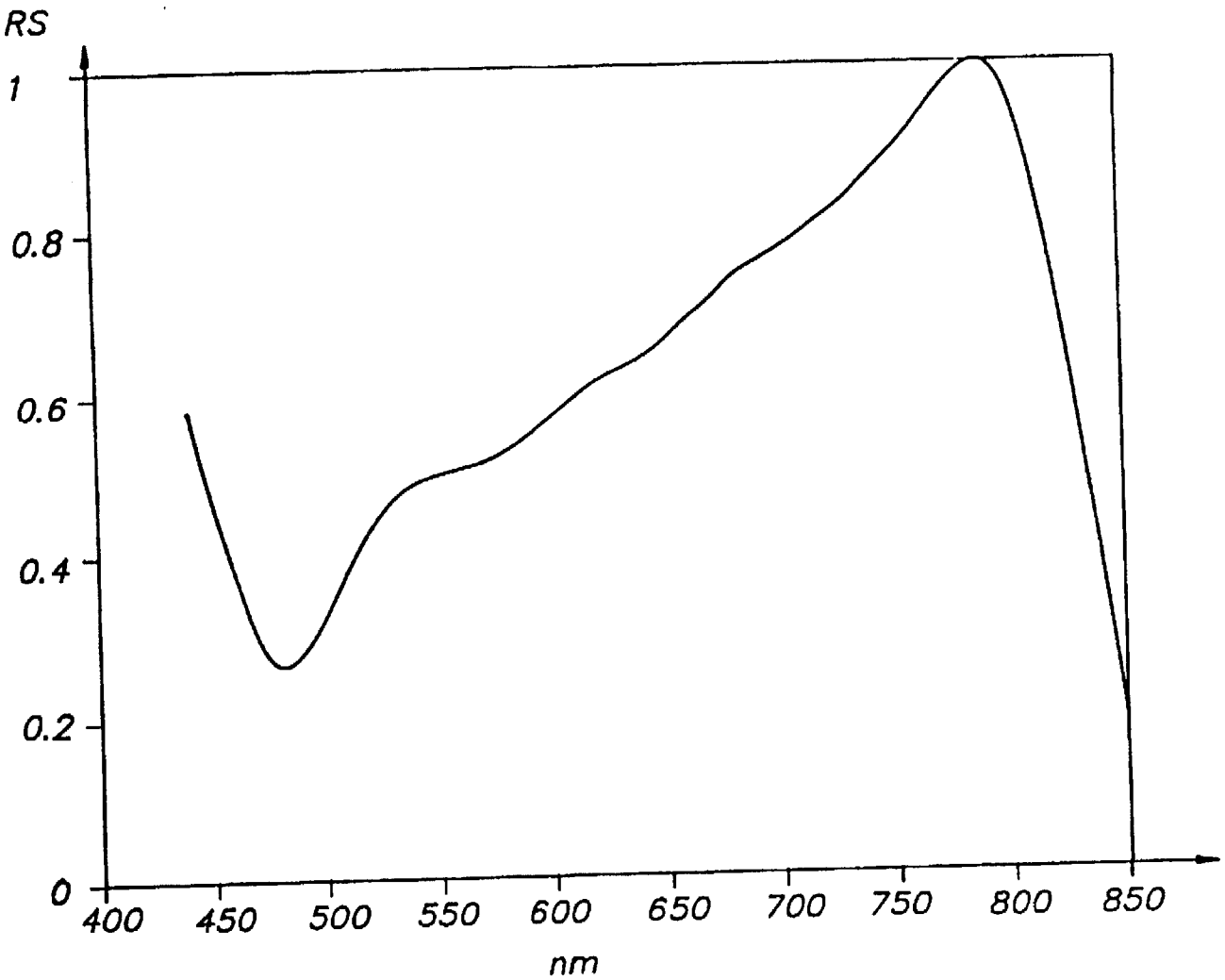
FIGS. 1 through 6 illustrate specific characteristics of the phthalocyanine compounds utilized according to the present invention. Thus.

The charge generation efficiency has been found to vary with the formula (I) phthalocyanine structure; molar ratio of unsubstituted metal-free phthalocyanine ($H_2Pc$) to formula (I) phthalocyanine in the mixed crystals and with (mixed) crystal modification.

According to a preferred embodiment the electrophotographic recording material according to the present invention contains a metal-free phthalocyanine pigment at least partially in the X-morphological form and consisting of mono-ortho substituted metal-free phthalocyanine within the scope of the above general formula (I) and/or mixed crystals of said mono-ortho substituted metal-free phthalocyanine with unsubstituted metal-free phthalocyanine.

According to another preferred embodiments the electrophotographic recording material according to the present invention contains a metal-free phthalocyanine pigment at least partially in the α-morphological form and consisting of mono-meta substituted metal free phthalocyanine within the scope of the above general formula (I) and/or mixed crystals of said mono-meta substituted metal-free phthalocyanine with unsubstituted metal-free phthalocyanine.

Substituted phthalocyanine pigments according to said general formula (I) and mixed crystal pigments of said substituted metal-free phthalocyanine with unsubstituted metal-free phthalocyanine are prepared by phthalocyanine ring-forming addition reaction of in 3- or 4-position R-substituted ortho-phthalodinitriles optionally with unsubstituted ortho-phthalo-dinitriles being present in a mole ratio sufficient to introduce in the mixed crystals the R-substituent in a statistical degree of substitution in the range of 0.1 to 4.0.

Said addition reaction proceeds in the presence of a base in a temperature range of 80°–300° C. in a suitable organic solvent. in 3-position R-substituted ortho-phthalo-dinitriles wherein R=—$CH_3$ are described in Chemical Abstracts reference number (CA-RN) 36715-97-6, R=—$OCH_3$ in CA-RN 19056-23-6, and R=—$OC_2H_5$ in CA-RN 116965-11-8.

The preparation of same R-substituted ortho-phthalo-dinitriles or mixtures of differently R-substituted ortho-phthalo-dinitriles may proceed analogously to procedures descibed by K. Venkataraman, "The Chemistry of Synthetic Dyes", Vol. II, Academic Press, Inc., New York, 1952, p. 1118–1142 or by N. M. Bigelow and M. A. Perkins in Lubs (Hrsg.), "The Chemistry of Synthetic Dyes and Pigments" Reinhold Publishing Corp., New York, 1955, p. 577–606 and therein mentioned literature.

Substituted phthalocyanine pigments according to said general formula (I) and mixed crystal pigments of said substituted metal-free phthalocyanine with unsubstituted metal-free phthalocyanine can be prepared either directly by reacting unsubstituted phthalocyanine precursors with appropriately substituted phthalocyanine precursors (e.g. in a 3:1 molar ratio) in the presence of specific bases or hydrogen as described, for example, by G. Booth in "The Synthesis of Synthetic Dyes, Volume V", edited by K. Ventakaraman (1971), pages 241 to 282, or indirectly by reacting unsubstituted phthalocyanine precursors with appropriately substituted phthalocyanine precursors to phthalocyanines in which the NH-groups are substituted or partially substituted with a moiety which is readily replaceable by hydrogen, e.g. an alkali or alkaline earth metal, and then converting the NH-group substituted phthalocyenines into metal-free phthalocyanines by treatment with water or an acid as also described in G. Booth's article.

Figure 2:
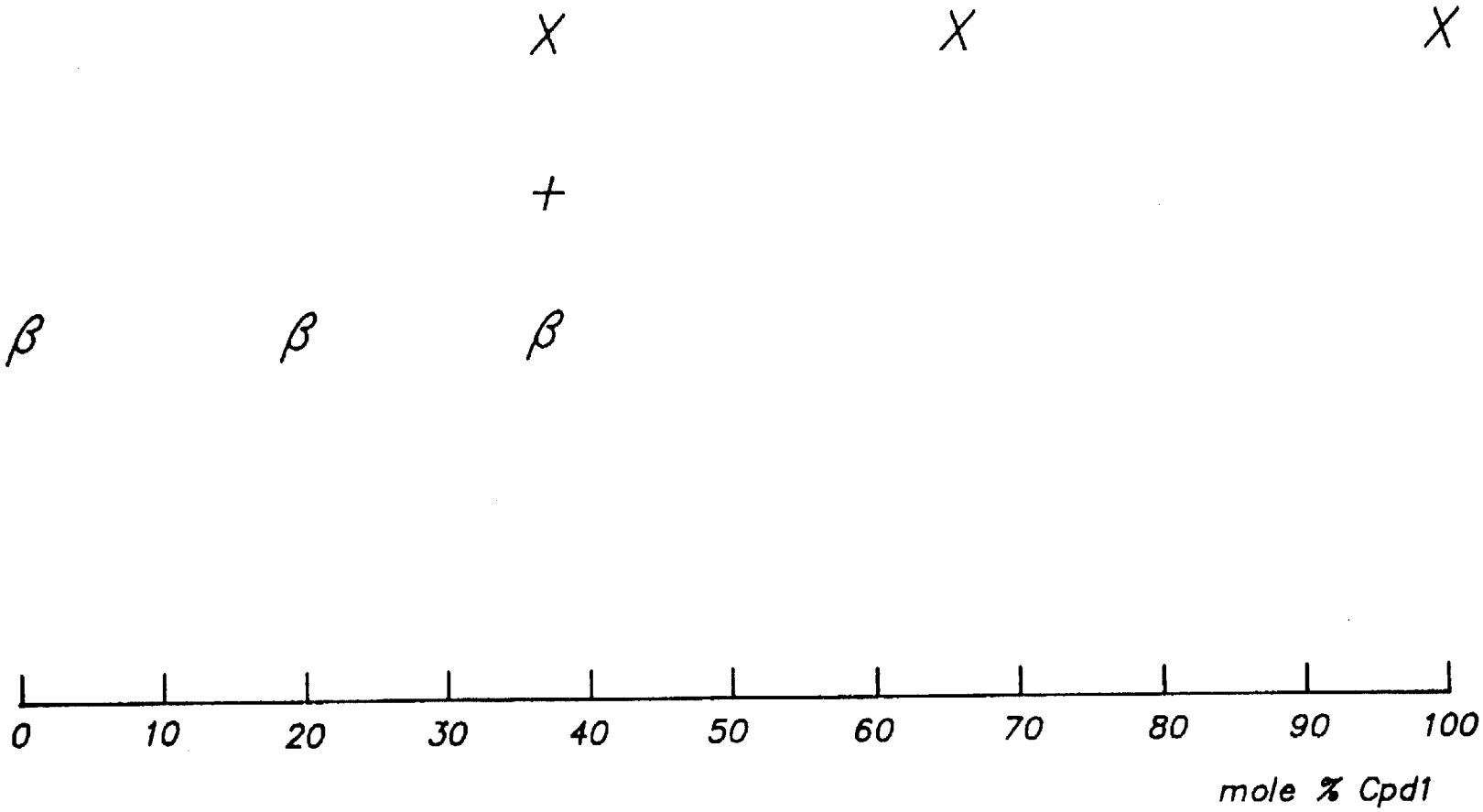
Figure 3:
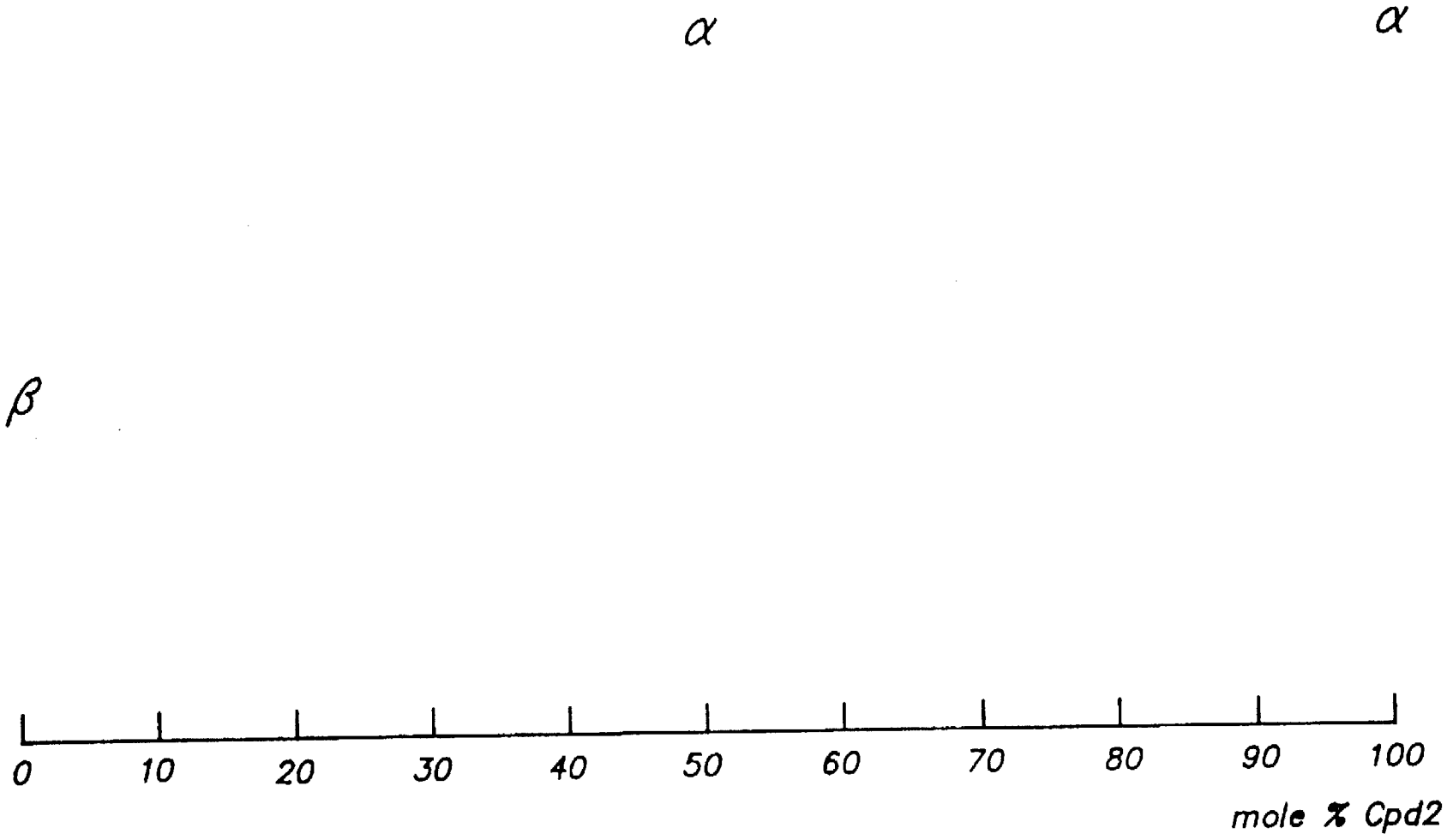
Figure 4:
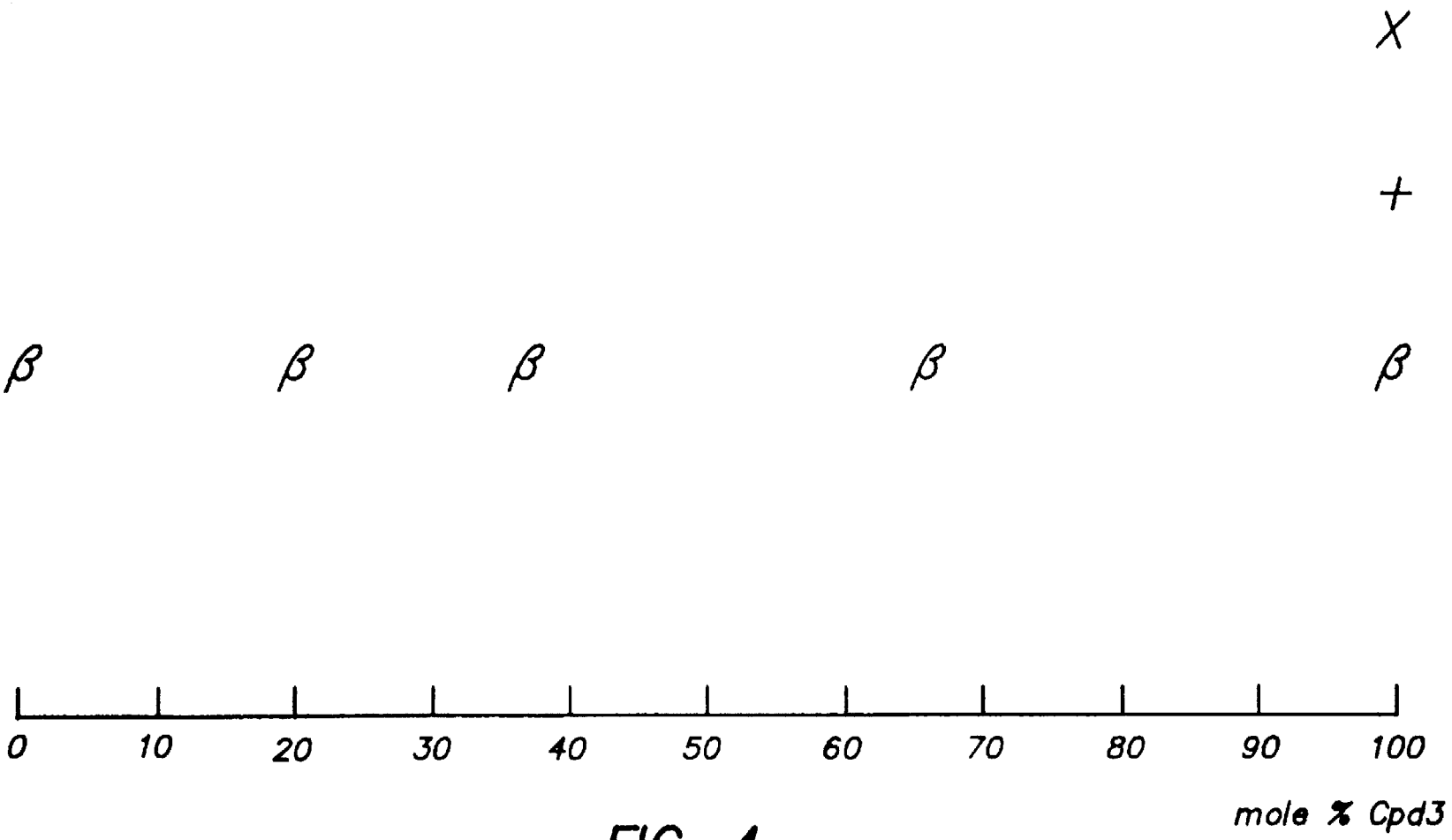

Direct synthesis of the substituted phthalocyenine pigments according to general formula (I) and mixed crystal pigments of said substituted metal-free phthalocyanine with unsubstituted metal-free phthalocyanine produces pigments in their thermally stable morphology, the morphology varying with composition. Indirect synthesis of said pigments usually produces finely divided pigments with an α-morphology. Treatment of said finely divided α-pigments with refluxing inert high boiling liquids such as α-methyl naphthalene converts them into their thermally stable morphologies, α, β, X or mixtures thereof [as identified by light absorption and X-ray diffraction spectra (see U.S. Pat. No. 3,357,989)] depending upon the molar ratio of unsubstituted metal-free phthalocyanine to substituted metal-free phthalocyanine and the substitutent in the substituted metal-free phthalocyanine as shown in FIGS. 2 to 4.

Different crystalline modifications of the substituted phthalocyanine pigments according to general formula (I) and mixed crystal pigments of said substituted metal-free phthalocyanine with metal-free phthalocyanine according to the present invention as characterized by X-ray diffraction and absorption spectra can also be produced by specific grinding conditions, contact with specific solvents at specific temperatures, acid pasting etc.

Mono-ortho substituted phthalocyanine pigments within the scope of said general formula (I) and mixed crystal pigments of said mono-ortho substituted metal-free phthalocyanine with metal-free phthalocyanine according to the present invention are produced in α, β, X morphologies or mixtures thereof via direct synthesis.

Mono-ortho substituted metal-free phthalocyanine pigment within the scope of said general formula (I) and said mixed crystal pigment with unsubstituted metal-free phthalocyanine can be obtained with their major part in X-morphological form by the treatment of their corresponding α-morphological modification with refluxing inert high boiling liquids such as α-methylnaphthalene.

Mono-meta substituted phthalocyanine pigments according to general formula (I) and mixed crystal pigments of said mono-meta substituted metal-free phthalocyanine with metal-free phthalocyanine are produced in α, β morphologies or mixtures thereof via direct synthesis.

Mono-meta substituted metal-free phthalocyanine pigment within the scope of said general formula (I) and said mixed crystal pigment with unsubstituted metal-free phthalocyanine can be obtained with their major part in highly crystalline α-morphological modification by the treatment of their corresponding poorly crystalline α-morphological modification with refluxing high boiling solvents such as α-methylnaphthalene.

We have found that for appropriate molar ratios of unsubstituted metal-free phthalocyanine to substituted metal-free phthalocyanine an α-morphology pigment with poor electro-optical properties and a limited spectral sensitivity can be converted into a pigment having good electro-optical properties and in the case of at least partial X-morphology a pigment with a much expanded spectral sensitivity is obtained.

Mixed X-morphology metal-free phthalocyanine pigments as set forth in the present invention are superior to X-morphology metal-free phthalocyanine pigments without said substituted metal-free phthalocyanine in a number of important respects:

i) they can be produced without resorting to acid pasting to convert β-type metal-free phthalocyanine to α-type metal-free phthalocyanine and grinding over long periods of time to convert the α-pigment into the X-pigment as described in U.S. Pat. No. 3,594,163 thereby avoiding the introduction of impurities (non-formula I phthalocyanine-containing metal-free phthalocyanine pigments produced according to the above described process are produced in a β-morphology and exhibit very poor electro-optical properties as shown in comparative example 2;

ii) they are thermally stable (non-formula I phthalocyanine-containing X-pigments revert to a β-morphology upon heating at 250° C. for 16 hours (see FIGS. 5 and 6), whereas formula I phthalocyanine containing X-pigments undergo no change in morphology under these conditions and hence are not susceptible to the X→β-pigment conversion experienced during energetic grinding of the X-pigment without substituted metal-free phthalocyanine;

iii) they exhibit superior dispersion characteristics in organic solvents;

iv) they exhibit superior electro-optical properties in organic photoconductors.

Figure 5A:
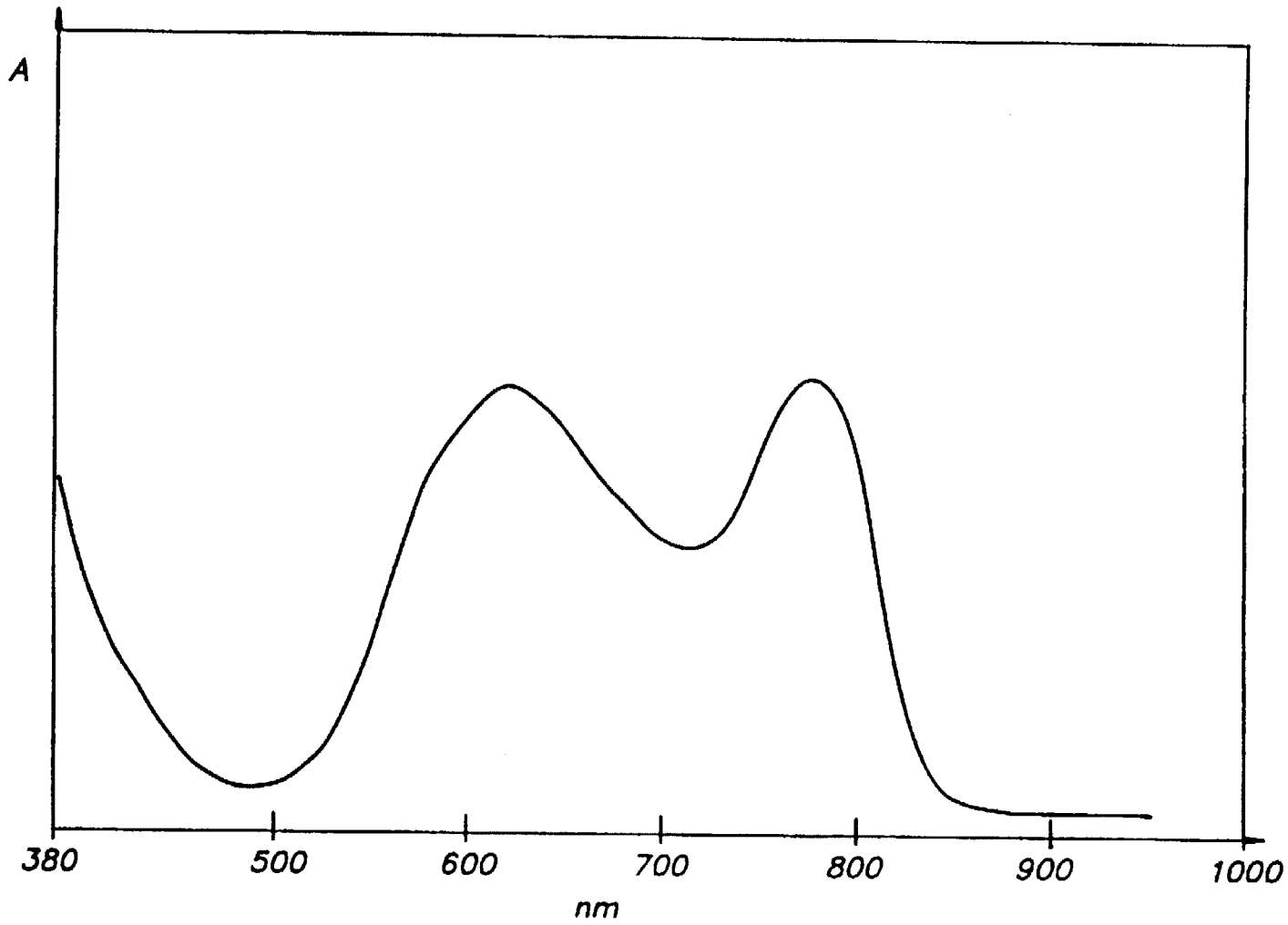
Figure 5B:
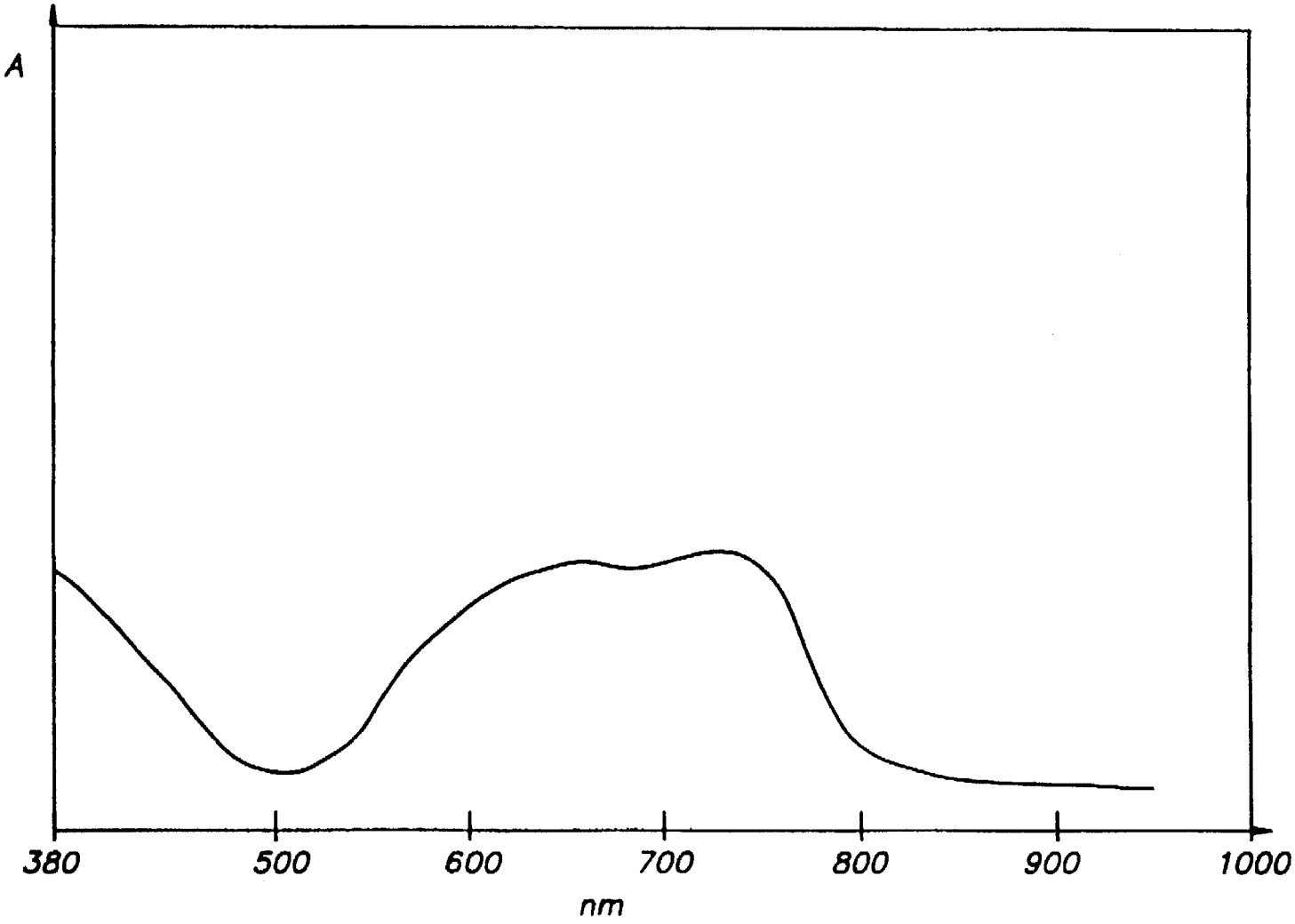

FIG. 5 shows the substantial change in absorption spectrum of unsubstituted X-metal-free phthalocyanine (FASTOGEN BLUE 8120B from Dainippon Ink and Chemicals Inc.) upon heating at 250 ° C. for 16 hours with two new peaks characteristic of the β-morphology at 655 and 730 nm (FIG. **5*b*) replacing the characteristic of the X-morphology peaks at 615 and 775 nm (FIG. 5*a***).

Figures 6A, 6B:
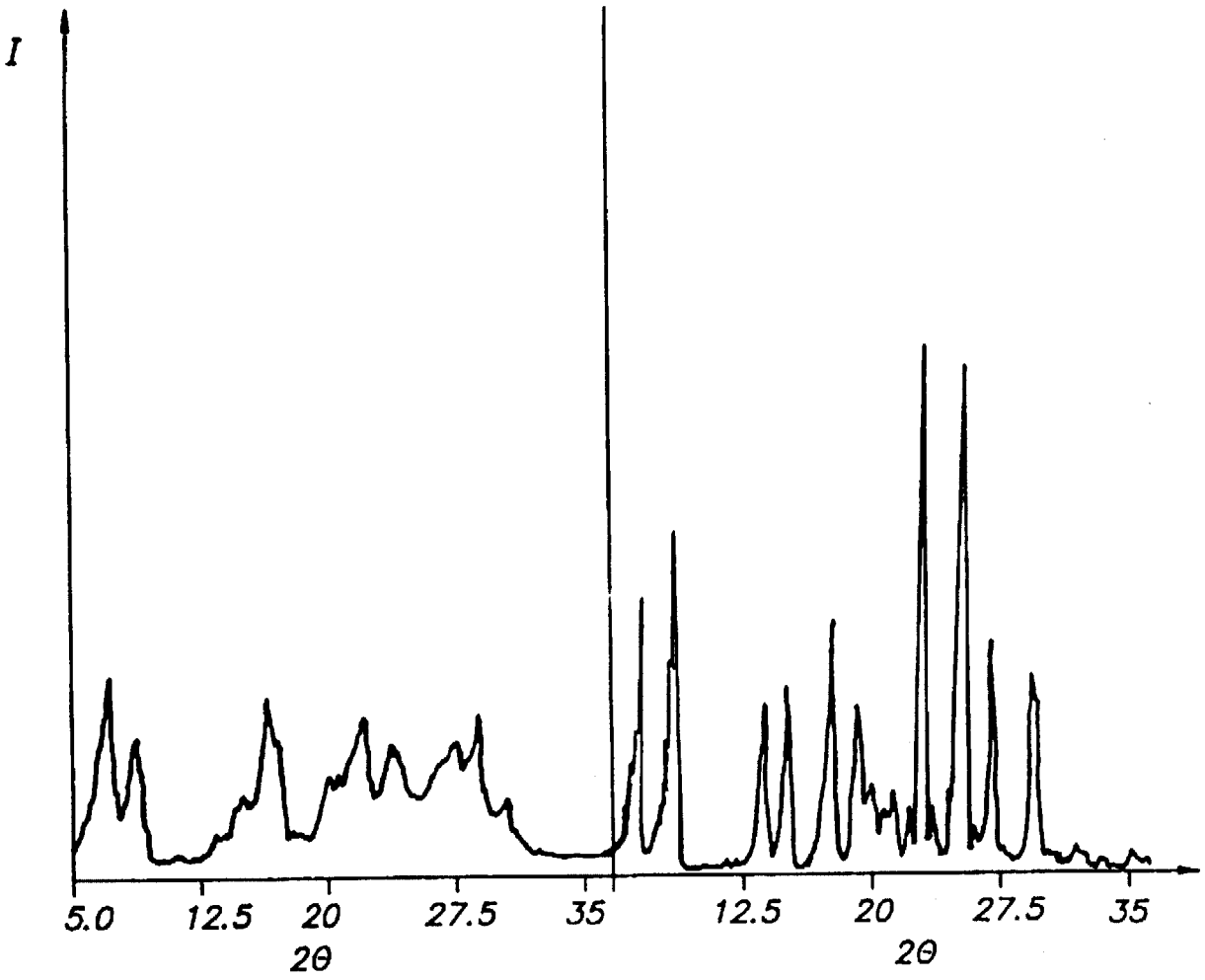

FIG. 6 shows the corresponding changes in the X-ray diffraction spectra with a spectrum characteristic of the β-morphology (FIG. **6*b*) replacing a spectrum characteristic of the X-morphology (FIG. 6*a***).

The morphological stabilization of otherwise unstable metal-free phthalocyanine morphologies afforded by the substituent R in the general formula (I) or by the presence of the substituted metal-free phthalocyanines according general formula (I) in mixed crystals with unsubstituted metal-free phthalocyanine enables these metal-free phthalocyanine pigments to be obtained with higher crystallinities and improved electro-optical properties.

Multilayer or single layer electrophotographic recording material containing said phthalocyanines mainly or completely in the X-form exhibit high photosensitivities in the wavelength range above 550 nm, e.g. 550 to 830 nm for X-morphology pigments and 550 to 780 nm for α-morphology pigments.

Preferred charge generating materials for use according to the present invention are mono-substituted metal-free phthalocyanine compounds corresponding to the above general formula (I) wherein R is $CH_3$.

In a preferred photoconductive recording material according to the present invention mixed crystals are used comprising mono-substituted metal-free phthalocyanine compounds according to said general formula (I) with unsubstituted metal-free phthalocyanine in a molar ratio range from 0.14 to 3.3.

Specific examples of phthalocyanines with formula (I) suitable for use according to the present invention are listed in Table 1 below.

TABLE 1

| Compound number | |
|---|---|
| 1 | 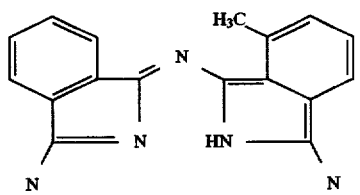 |
| 2 | 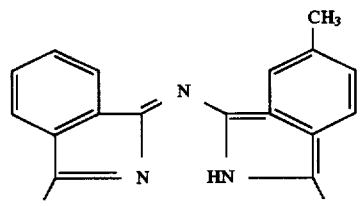 |
| 3 | 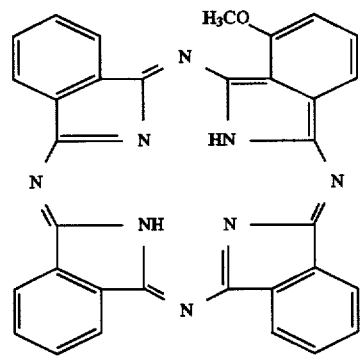 |

For the production of an electrophotographic recording material according to the present invention at least one metal-free phthalocyanine pigment according to general formula (I), optionally in the form of a mixed crystal with unsubstituted metal-free phthalocyanine is applied:

(1) as an active component in a single insulating resin binder layer to an electrically conductive substrate, or (2) together with a charge transport material in the same resin binder to an electrically conductive substrate, or (3) in combination with a resin binder to form a charge generation layer adhering directly to a charge transporting layer (CTL), the two layers being supported by an electrically conductive substrate.

The ratio wherein the charge generating phtalocyanine pigment(s) and the resin binder are mixed can vary. However, relatively specific limits are imposed, e.g. to avoid flocculation. A useful content of said pigment in a photosensitive layer according to the present invention is in the range of 0.05 to 90 % by weight with respect to the total weight of said layer, and preferably in the range of 5 to 70 % by weight.

The preferred pigment content in a charge generating layer is in the range 30 to 70 % by weight with respect to the total weight of said layer. The photosensitive layer in a single active layer system is preferably less than 30 μm thick, as charge generating layer preferably less than 5 μm thick, more preferably less than 2 μm thick.

Charge transport layers in the photoconductive recording materials of the present invention preferably have a thickness in the range of 5 to 50 μm, more preferably in range of 5 to 30 μm. If these layers contain low molecular weight charge transport molecules, such compounds will preferably be present in concentrations of 30 to 70 % by weight.

According to a particular embodiment of the present invention an electrophotographic recording material comprises an electrically conductive support having thereon a positively chargeable photoconductive recording layer which contains in an electrically insulating organic polymeric binder at least one p-type pigment substance and at least one n-type photoconductive charge transport substance, wherein (i) at least one of the p-type pigment substances is a compound corresponding to the above general formula (I) or a mixed crystal pigment comprising a p-type compound corresponding to general formula (I) in a molar ratio range from 0.14 to 3.3 with unsubstituted metal-free phthalocyanine, (ii) said layer has a thickness in the range of 4 to 40 μm and comprises 5 to 40 % by weight of said p-type pigment substances and 0.0001 to 15 % by weight of at least one of said n-type charge transport substance(s) that is (are) molecularly distributed in said electrically insulating organic polymeric binder material that has a volume resistivity of at least $10^{14}$ Ohm-m, and wherein (iv) said recording layer in electrostatically charged state requires for 10 % and 90 % discharge respectively exposures to conductivity increasing electromagnetic radiation that differ by a factor 4.5 or less. Optionally the support of said photoconductive recording layer is pre-coated with an adhesive and/or a blocking layer (rectifier layer) reducing or preventing charge injection from the conductive support into the photoconductive recording layer, and optionally the photoconductive recording layer is overcoated with an outermost protective layer.

In accordance with a preferred mode of said last mentioned embodiment said photoconductive recording layer has a thickness in the range of 5 to 35 μm and contains 6 to 30 % by weight of said p-type pigment material(s) and 0.001 to 12 % by weight of said n-type transport substance (s).

According to another embodiment of the present invention an electrophotographic recording material comprises an electrically conductive support having thereon a negatively chargeable photoconductive recording layer which contains in an electrically insulating organic polymeric binder at least one n-type pigment substance and at least one p-type charge transport substance, wherein (i) at least one of the n-type pigment substances is a compound corresponding to general formula (I) or a mixed crystal pigment comprising a p-type compound corresponding to said general formula (I) in a molar ratio range from 0.14 to 3.3 with unsubstituted metal-free phthalocyanine, (ii) the half wave oxidation potentials of in admixture applied p-type charge transport substances relative to standard saturated calomel electrode do not differ by more than 0.400 V, (iii) said layer has a thickness in the range from 4 to 40 μm and comprises 8 to 80 % by weight of said n-type pigment substance and 0.01 to 40 % by weight of at least one of said p-type charge transport substance(s) that is (are) molecularly distributed in said electrically insulating organic polymeric binder material that has a volume resistivity of at least $10^{14}$ Ohm-m, and wherein (iv) said recording layer in electrostatically charged state requires for 10 % and 90% discharge respectively exposures to conductivity increasing electromagnetic radiation that differ by a factor 4.5 or less. Optionally the support of said photoconductive recording layer is pre-coated with an adhesive and/or a blocking layer (rectifier layer) reducing or preventing charge injection from the conductive support into the photoconductive recording layer, and optionally the photoconductive recording layer is overcoated with an outermost protective layer.

In accordance with a preferred mode of said last mentioned embodiment said photoconductive recording layer has a thickness in the range of 5 to 35 μm and contains 10 to 70% by weight of said n-type pigment material(s) and 1 to 30% by weight of said p-type transport substance (s).

By the term "n-type" material is understood a material having n-type conductance, which means that the photocurrent ($I_n$) generated in said material when in contact with an illuminated transparent electrode having negative electric polarity is larger than the photocurrent ($I_p$) generated when in contact with a positive illuminated electrode ($I_n/I_p>1$).

By the term "p-type" material is understood a material having p-type conductance, which means that the photocurrent ($I_p$) generated in said material when in contact with an illuminated transparent electrode having positive electric polarity is larger than the photocurrent ($I_n$) generated when in contact with a negative illuminated electrode ($I_p/I_n>1$).

The resin binders are selected on the basis of optimal mechanical strength, adhesion and favourable electrical properties. A particular resin may be only suitable for use in charge generating layers in combination with negative charge transporting CTL's or in combination with positive charge transporting CTL's.

Suitable binder resins for use in the charge generating layer may be hardened or unhardened resins. Suitable unhardened resins are, for example, cellulose esters, acrylate and methacrylate resins, cyanoacrylate resins, polyvinyl chloride, copolymers of vinyl chloride, e.g. a copolymer of vinyl chloride with vinyl acetate and maleic anhydride, polyvinyl acetal resins e.g. polyvinyl butyral, polyester resins, e.g. copolyesters of isophthalic acid and terephthalic acid with glycol, aromatic polyester-carbonate resins or aromatic polycarbonate resins.

Suitable hardened resins are, for example, phenoxy and epoxy resins hardened with polyisocyanates, epoxy resins hardened with polyaminoamide resins, epoxy resins hardened with amines and hydroxy-group containing polymers hardened with polyisocyanates.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of the following general formula (II):

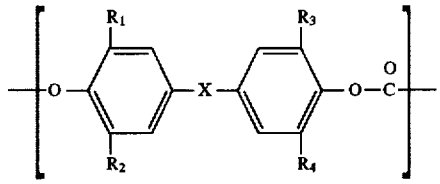

(II)

wherein:

X represents S, $SO_2$,

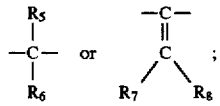

$R_1$, $R_2$, $R_3$, $R_4$, $R_7$ and $R_8$ each represents (same or different) hydrogen, halogen, an alkyl group or an aryl group, and $R_5$ and $R_6$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10,000 to 200,000 are preferred. Suitable polycarbonates are sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R_1=R_2=R_3=R_4=H$, X is $R_5—C—R_6$ with $R_5=R_6=CH_3$.

MAKROLON 5700 (registered trade mark) is a bisphenol A polycarbonate with molecular weight in the range of 50,000 to 120,000 wherein $R_1=R_2=R_3=R_4=H$, X is $R_5—C—R_6$ with $R_5=R_6—CH_3$.

Bisphenol Z polycarbonate is an aromatic polycarbonate containing recurring units wherein $R_1=R_2=R_3=R_4=H$, X is $R_5—C—R_6$, and $R_5$ together with $R_6$ represents the necessary atoms to close a cyclohexane ring.

Further useful binder resins are silicone resins, polystyrene and copolymers of styrene and maleic anhydride and copolymers of butadiene and styrene.

An example of an electronically active resin binder is poly-N-vinylcarbazole or copolymers thereof.

Preferred binders for the negative charge transporting layers of the present invention are homo- or co-polycarbonates with the general formula:

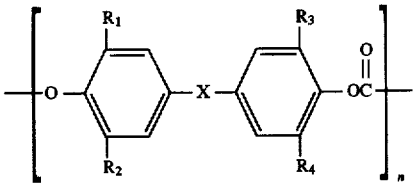

wherein: X, $R_1$, $R_2$, $R_3$ and $R_4$ have the same meaning as described in general formula (II) above. Specific polycarbonates useful as n-CTL-binders in the present invention are B1 to B7.

The presence of one or more spectral sensitizing agents can have an advantageous effect on the charge transport. In that connection reference is made to the sensitizing dyes described in U.S. Pat. No. 3,832,171 and 4,028,102. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The positive charge transporting layer may contain compounds substituted with electron-acceptor groups forming an intermolecular charge transfer complex, i.e. donor-acceptor complex when electron donor charge transport

B1

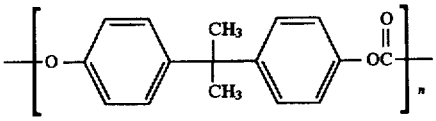

B2

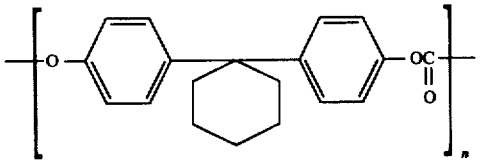

B3

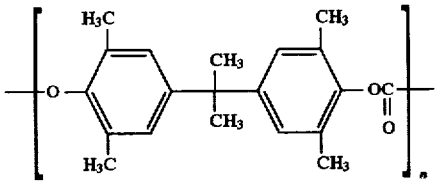

B4

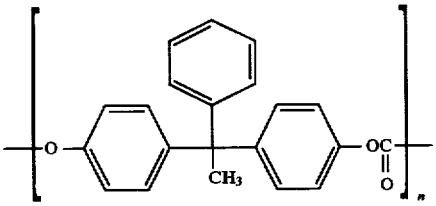

B5

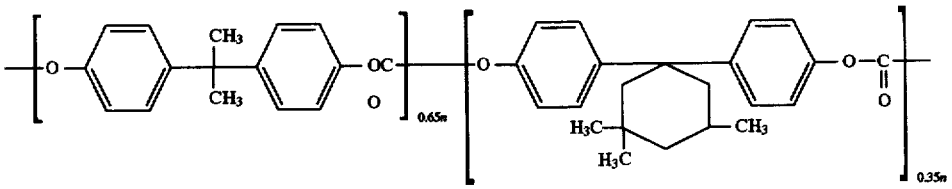

B6

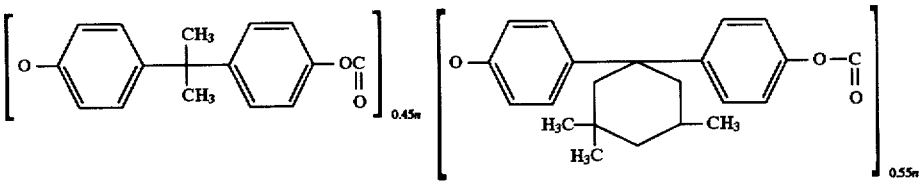

B7

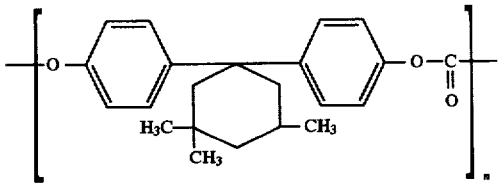

compounds are present. Useful compounds having electron-accepting groups are nitrocellulose and aromatic nitro-compound such as nitrated fluorenone-9 derivatives, nitrated 9-dicyanomethylene fluorenone derivatives, nitrated naphthalenes and nitrated naphthalic acid anhydrides or imide derivatives. The preferred concentration range of said compounds having electron acceptor groups is such that the donor/acceptor weight ratio is 2.5:1 to 1,000:1.

The negative charge transporting layer may contain compounds substituted with electron-donor groups forming an intermolecular charge transfer complex, i.e. donor-acceptor complex wherein the hydrazone compound represents an electron donating compound. Useful compounds having electron-donating groups are hydrazones such as 4-N,N-diethylamino-benzaldehyde-1,1-diphenylhydrazone (DEH), amines such as tris(p-tolylamine) (TTA) and N,N'-diphenyl-N,N'-bis (3-methylphenyl)-[1,1-biphenyl]-4,4' -diamine (TPD) etc. The optimum concentration range of said derivatives is such that the acceptor/donor weight ratio is 2.5:1 to 1,000:1.

Compounds acting as stabilizing agents against deterioration by ultra-violet radiation, so-called UV-stabilizers, may also be incorporated in said charge transport layer. Examples of UV-stabilizers are benztriazoles.

As charge transport compounds for use in a recording material according to the present invention any of the known charge transport compounds mentioned hereinbefore may be used. Particularly good results are obtained with the charge transport compounds used in the photoconductive recording materials described in U.S. Pat. No. 4,923,554, U.S. Pat. No. 4,943,502, U.S. Pat. No. 5,043,238, EP 452,569A, EP 462,327A and our European patent applications Nos. 534,514 A, 534,005 A, 537,808 A and 534,004 A.

For controlling the viscosity and aiding deaeration of the coating compositions and controlling their optical clarity silicone oils may be added to the charge transport layer.

The charge transport layer used in the recording material according to the present invention possesses the property of offering a high charge transport capacity coupled with a low dark discharge. While with the common single layer photoconductive systems an increase in photosensitivity is coupled with an increase in the dark current and fatigue such is not the case in the double layer arrangement wherein the functions of charge generation and charge transport are separated and a photosensitive charge generating layer is arranged in contiguous relationship to a charge transporting layer.

In some cases it may be advantageous to use a plasticizing agent in the charge generating and/or charge transporting layer, e.g. halogenated paraffin, polybiphenyl chloride, dimethylnaphthalene or dibutyl phthalate.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminum oxide layer acting as blocking layer preventing positive or negative charge injection from the support side. The thickness of said barrier layer is preferably not more than 1 micron (μm).

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps:

(1) overall electrostatically charging the photosensitive layer, said layer being present on said conductive support either as a single active layer or as a photosensitive charge generating layer in contact with a charge transporting layer in a layer system containing two active layers on said support, and (2) image-wise photo-exposing the photosensitive layer (s) of said recording material thereby obtaining a latent electrostatic image.

The photo-exposure of the photosensitive charge generating layer proceeds preferably through the charge transporting layer in the case of two layer recording materials with the charge generating layer between the support and the charge transporting layer, but may be direct if the charge generating layer is the outermost layer or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image relationship to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development my be dissipated before starting a next copying cycle by overall exposure and/or alternating current corona treatment.

Recording materials according to the present invention depending on the spectral. sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The structures of the positive charge transporting charge transporting materials (CTM's) (P1 to P11) used in the examples are summarized below with their reference numbers:

(P1)

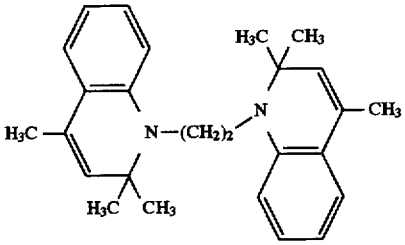

(P2)

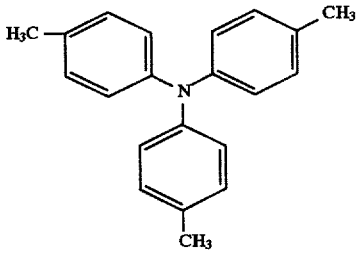

(P3)

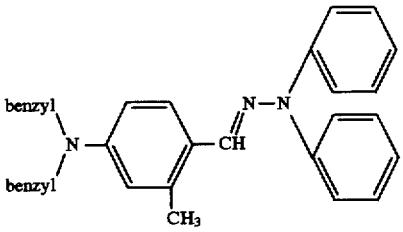

(P4)

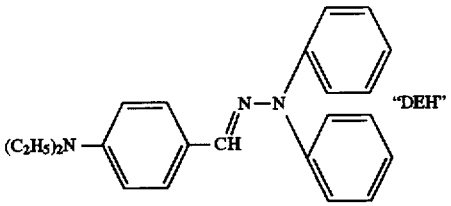

"DEH"

(P5)

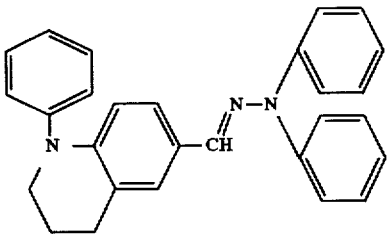

(P6)

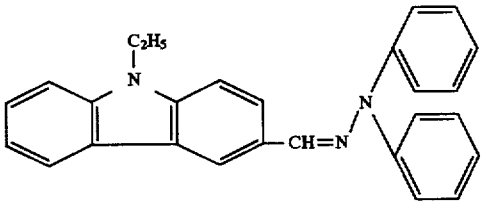

(P7)

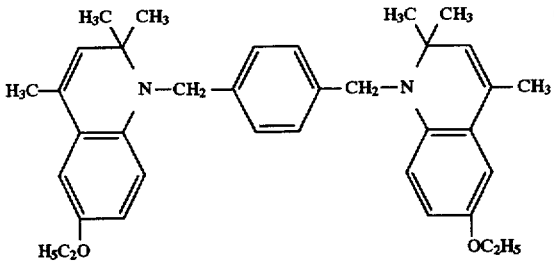

(P8)

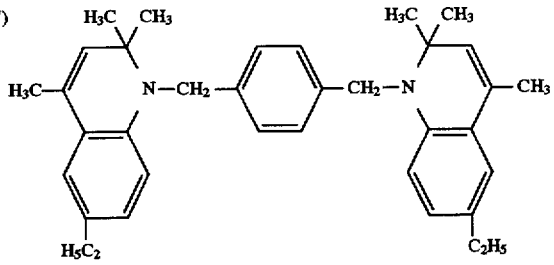

(P9)

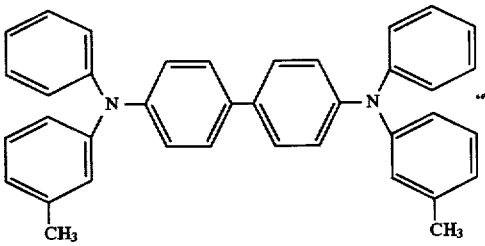

"TPD"

-continued
(P10)
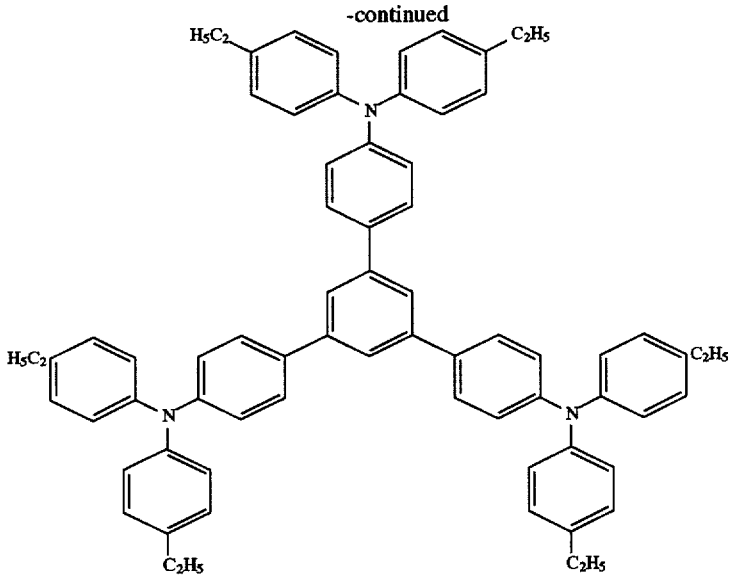
(P11)
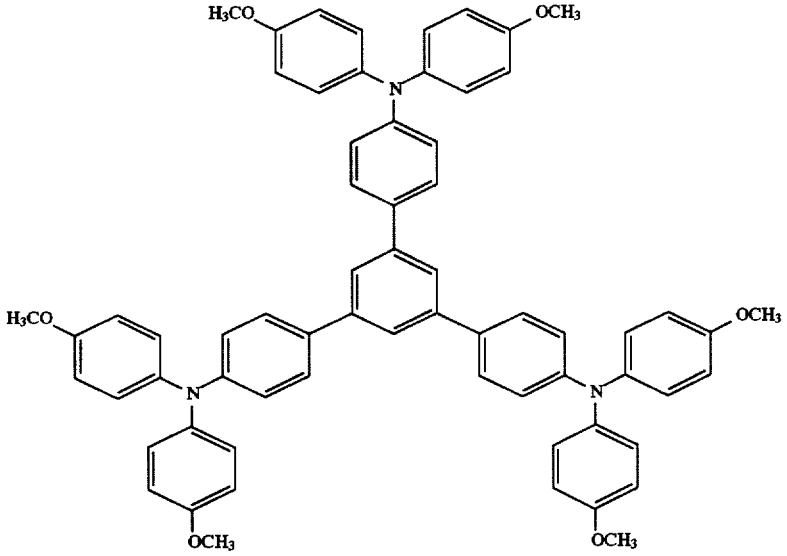
The structures of the negative charge transporting CTM's (N1 to NS) used in the examples are summarized below with their reference numbers:
(N1)
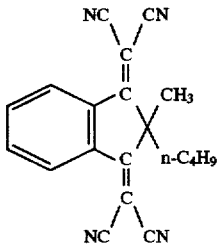
-continued
(N2)
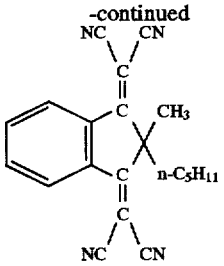
(N3)
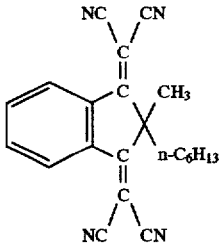

-continued (N4)

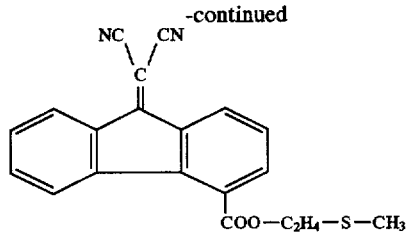

(N5)

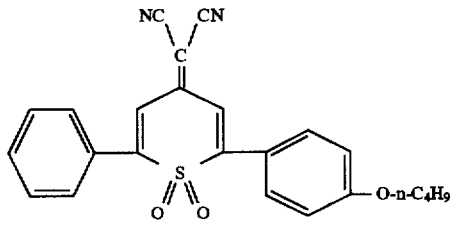

(N6)

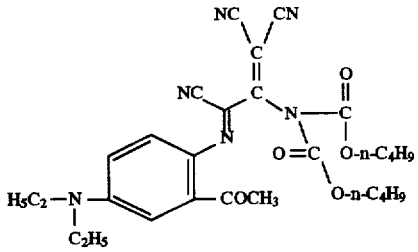

(N7)

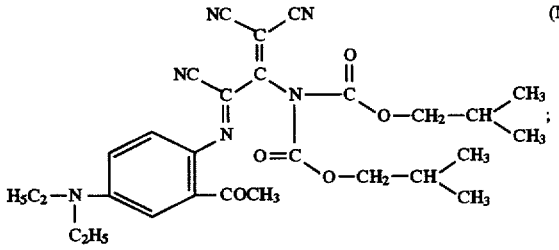

(N8)

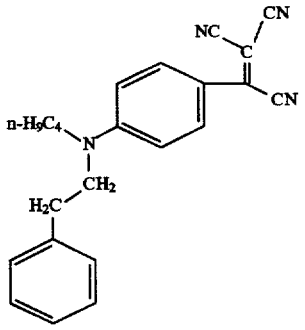

The evaluations of electrophotographic properties determined on the recording materials of the following examples relate to the performance of the recording materials in an electrophotographic process with a reusable photoreceptor. The measurements of the performance characteristics were carried out by using a sensitometric measurement in which the discharge was obtained for 16 different exposures in addition to zero exposure. The photoconductive recording sheet material was mounted with its conductive backing on an aluminum drum which was earthed and rotated at a circumferential speed of 10 cm/s. The recording material was sequentially charged with a negative corona at a voltage of −5.7 kV operating with a grid voltage of −600 V or with a positive corona at a voltage of +5.7 kV operating with a grid voltage of +600 V. Subsequently the recording material was exposed (simulating image-wise exposure) with a light dose of monochromatic light obtained from a monochromator positioned at the circumference of the drumat an angle of 45° with respect to the corona source. The photo-exposure lasted 200 ms. Thereupon, the exposed recording material passed an electrometer probe positioned at an angle of 180° with respect to the corona source. After effecting an overall post-exposure with a halogen lamp producing 355 mJ/m2 positioned at an angle of 270° with respect to the corona source a new copying cycle started. Each measurement relates to 80 copying cycles in which the photoconductor is exposed to the full light source intensity for the first 5 cycles, then sequentially to the light source the light output of which is moderated by grey filters of optical densities 0.2, 0.38, 0.55, 0.73, 0.92, 1.02, 1.20, 1.45, 1.56, 1.70, 1.95, 2.16, 2.25, 2.51 and 3.21 each for 5 cycles and finally to zero light intensity for the last 5 cycles.

The electro-optical results quoted in the EXAMPLES 3 to 21 and COMPARATIVE EXAMPLE 2 hereinafter refer to charging level at zero light intensity (CL) and to discharge at a light intensity corresponding to the light source intensity moderated by a grey filter to the exposure indicated to a residual potential RP.

The % discharge is:

$$\frac{(CL - RP)}{CL} \times 100$$

For a given corona voltage, corona grid voltage, separating distance of the corona wires to recording surface and drum circumferential speed the charging level CL is only dependent upon the thickness of the charge transport layer and its specific resistivity. In practice CL expressed in volts should be preferably ≧30 d, where d is the thickness in μm of the charge transport layer.

All ratios and percentages mentioned in the Examples are by weight unless mentioned otherwise.

EXAMPLE 1

Preparation of a charge generating mixed crystal consisting of a 1.75:1 molar mixture of metal-free phthalocyanine and compound 1 of Table 1 in a mixed X- and β-crystal modification.

A) 1,2-dicyano-3-methylbenzene can be prepared, for example, using the synthesis described by Gabriel and Thieme in Berichte, Volume 52, page 1082.

B) Preparation of mixed crystal pigment consisting of a 1.75:1 molar mixture of metal-free phthalocyanine and compound 1 of Table 1 in the α-crystal modification.

1.3 g of 1,2-dicyano-3-methylbenzene (0.00914 moles) and 11.6 g of phthalonitrile (0.09053 moles) were dissolved in 150 g of amyl alcohol. 15 ml of a 30 % sodium methylate solution in methanol were then added and the reaction mixture heated under reflex for 6 hours. The disodium salt formed was filtered off from the cooled reaction mixture, suspended in 100 ml of 10 % hydrochloric acid for 30 minutes with stirring at room temperature. Since each substituted or unsubstituted phthalocyanine molecule is built up of four substituted or unsubstituted phthalonitrile molecules. the molar ratio of phthalonitrile to 1,2-dicyano-3-methylbenzene molecules. MR, can be used to calculate the molar ratio of metal-free phthalocyanine to compound 1o which for MR ≧3 is (MR −3)/4:1. The resulting mixed crystal pigment produced using a 10:1 molar ratio of phthalonitrile to 1,2-dicyano-3-methylbenzene, consisting of a 1.75:1 molar mixture of metal-free phthalocyanine (built up of 1.75×4=7 phthalonitrile molecules) and compound 1 (built up of 3 phthalonitrile molecules and one 1.2-dicyano- 3-methylbenzene molecule) in the a-crystal modification. It was then filtered off, washed to neutrality with water and then dried at 50° C. 8.7 of a petrol-coloured pigment was obtained.

C) Preparation of mixed crystal pigment consisting of a 1.75:1 molar mixture of metal-free phthalocyanine and compound 1 of Table 1 in a mixed X- and β-crystal modification.

8.7 g of the pigment in the α-crystal modification were treated with 250 ml of α-methyl naphthalene under reflux for 24 hours whereupon a mixed X- and β-crystal modification was produced, as confirmed by X-ray diffraction analysis, in a yield of 8.0 g.

EXAMPLE 2

Preparation of a charge generating mixed crystal pigment consisting of a 1:1 molar mixture of unsubstituted metal-free phthalocyanine and compound 2 of Table 1 in the α-crystal modification.

A) 1,2-dicyano-4-methylbenzene can be prepared, for example, using the synthesis described by Morgan and Coulson in Journal of the Chemical Society (1929), p. 2557; or Glock in Berichte, Volume 21, p. 2663.

B) Preparation of mixed crystal pigment consisting of a 1:1 molar mixture of metal-free phthalocyanine and compound 2 of Table 1 in the α-crystal modification.

1.8 g of 1,2-dicyano-4-methylbenzene and 11.2 g of phthalonitrile were dissolved in 150 ml of amyl alcohol. 15 ml of a 30 % sodium methylate solution in methanol were then added and the reaction mixture heated under reflux for 6 hours. After cooling, the disodium salt formed was filtered off, suspended in 100 ml of water and was the treated with 100 ml of 10% hydrochloric acid for 30 minutes at room temperature. The resulting mixed crystal pigment consisting of a 1:1 molar mixture of metal-free phthalocyanine and 2-methyl-metal-free phthalocyanine in the α-crystal modification was then filtered off, washed to neutrality with water and then dried at 50 ° C. 8.6 g of a petrol-coloured pigment were obtained.

8.6 g of said pigment in the α-crystal modification were treated with 250 ml of α-methylnaphthalene under reflux for 24 hours whereupon the α-crystal modification was retained, as confirmed by X-ray diffraction analysis, in a yield of 7.9 g.

COMPARATIVE EXAMPLE 1

Preparation of a metal-free phthalocyanine pigment using the procedure described in EXAMPLE 1 (B) and 1 (C).

12.8 g of phthalonitrile were dissolved in 150 ml of amyl alcohol. 15 ml of a 30 % sodium methylate solution in methanol were then added and the reaction mixture heated under reflux for 6 hours. After cooling, the disodiumphthalocyanine salt formed was filtered off, suspended in 100 ml of water and then treated with 100 ml of 10 % hydrochloric acid for 30 minutes with stirring at room temperature. The α-metal-free phthalocyanine (α-$H_2Pc$) formed was filtered off, washed to neutrality with water and then dried at 50° C. 8.8 g of a petrol-coloured pigment were obtained.

8.8 g of said α-$H_2Pc$ were then treated with 250 ml of α-methyl naphthalene under reflux for 24 hours. The β-crystal modification was produced as confirmed by X-ray diffraction analysis in a yield of 8.0 g.

EXAMPLE 3

An electrophotographic recording material was produced by coating a 175 μm thick polyester film vapour-coated with a conductive layer of aluminum successively with a hydrolyzed silane adhesive layer, a dispersion of charge generating pigment to a thickness of 0.6 μm and a filtered solution of charge transport substance and binder to a thickness of 12.4 μm. The coating proceeded in each case with a doctor-blade coater.

The hydrolyzed silane adhesive layer was prepared by coating a 3 % by weight solution of γ-aminopropyl triethoxy silane on the aluminized polyester substrate and hydrolyzing/polymerizing it at 100° C. for 30 minutes.

The charge generating pigment dispersion was prepared by mixing 1 g of a mixed X- and β-crystal modification of a mixed crystal pigment consisting of a 1.75:1 molar mixture of metal-free unsubstituted phthalocyanine and compound 1 of Table 1 prepared as described in example 1, 0.15 g of MAKROLON CD 2000 (tradename) and 10.34 g of dichloromethane for 40 hours in a ball mill. 0.85 g of MAKROLON CD 2000 (tradename) and 7.65 g of dichloromethane were then added and the dispersion mixed for a further 15 minutes. Said layer was dried for 15 minutes at 80 ° C. prior to overcoating with a transport layer composition being a filtered solution of 1.8 g of 1,3-bis-dicyanomethylene-2-methyl-2-n-pentyl-indan-1,3-dione (N2), 2.2 g of MAKROLON 5700 (tradename) and 26.6 g of dichloromethane. This layer was then dried for 16 hrs at 50° C.

The characteristics of the thus obtained photoconductive recording material were determined with a light dose of 10 mJ/m2 of 660 run light as described above with the following results:

CL=+506 V

RP=+93 V

% Discharge=81.6

Dark discharge in 1st 30 s=343 V

EXAMPLES 4 TO 6 AND COMPARATIVE EXAMPLE 2

The photoconductive recording materials of examples 4 to 6 were produced as described in example 3 except that the pigments used were produced using a procedure analogous to that described in example 1 using the following molar ratios of phthalonitrile to 1,2-dicyano-3-methylbenzene: 3:1 (giving the pigment of example 4 with a stoichiometry corresponding to compound 1), 5:1 (giving the pigment of example 5 with a stoichiometry corresponding to a $H_2Pc$: Cpd 1 molar ratio of 0.5:1), 10:1 (giving the pigment of example 3 with a stoichiometry corresponding to a $H_2Pc$: Cpd 1 molar ratio of 1.75:1) and 20:1 (giving the pigment of example 6 with a stoichiometry corresponding to a $H_2Pc$: Cpd 1 molar ratio of 4.25:1).

The electro-optical characteristics of the thus obtained photoconductive recording materials were determined as described above and the results are summarized in Table 2.

TABLE 2

| | CGM | | | | | | |
|---|---|---|---|---|---|---|---|
| | Molar ratio | Crystal | | $I_{660}t$ = 20 mJ/m2 | | | Dark discharge |
| Example No. | $H_2Pc$: Cpd 1 | modification | $d_{CTL}$ [μm] | CL [V] | RP [V] | % Discharge | in 1st 30 s [V] |
| 4 | 0:1 | X | 13.4 | +510 | +98 | 80.8 | 316 |
| 5 | 0.5:1 | X | 13.4 | +508 | +101 | 80.1 | 333 |
| 3 | 1.75:1 | X + β | 12.4 | +506 | +93 | 81.6 | 343 |

TABLE 2-continued

| Example No. | CGM Molar ratio $H_2Pc$: Cpd 1 | CGM Crystal modification | $d_{CTL}$ [μm] | $I_{660}t$ = 20 mJ/m2 CL [V] | RP [V] | % Discharge | Dark discharge in 1st 30 s [V] |
|---|---|---|---|---|---|---|---|
| 6 | 4.25:1 | β | 10.4 | +489 | +89 | 81.8 | 320 |
| Comp. Ex. No. 2 | 1.0:0 | β | 9.4 | +338 | +297 | 12.1 | 218 |

EXAMPLES 7 TO 9

The photoconductive recording materials of examples 7 to 9 were produced as described in Example 5 except that different p-CTM's were used as the CTM instead of N2. The CTL layer thicknesses are given in Table 3 together with CTM and CTM concentrations used.

The electro-optical properties of the thus obtained photoconductive recording materials were determined as described above and the results are summarized in Table 3.

TABLE 3

| Example No. | CTM | CTM conc. [wt %] | $d_{CTL}$ [μm] | $I_{660}t$ = 20 mJ/m² CL [nm] | RP [V] | % discharge | dark discharge in 1st 30 s [V] |
|---|---|---|---|---|---|---|---|
| 7 | P1 | 50 | 12.4 | −589 | −409 | 30.6 | 226 |
| 8 | P2 | 40 | 12.4 | −561 | −381 | 32.1 | 249 |
| 9 | P10 | 40 | 12.4 | −542 | −339 | 37.5 | 278 |

EXAMPLES 10 TO 15

The photoconductive recording materials of examples 10 to 15 were produced as described in Example 3 except that an Q-crystal modification mixed crystal pigment consisting of a 1:1 molar mixture of metal-free phthalocyanine and compound 2 produced as described in Example 2 was used as the charge generating material and different n-CTM's were used as the CTM. The CTL layer thicknesses are given in Table 4 together with the CTM and CTM concentrations used.

The electro-optical properties of the thus obtained photoconductive recording materials were determined as described above and the results are summarized in Table 4.

TABLE 4

| Example No. | CTM | CTM conc. [wt %] | $d_{CTL}$ [μm] | λ [μm] | It = 20 mJ/m² CL [V] | RP [V] | % discharge | dark discharge in 1st 30 s [V] |
|---|---|---|---|---|---|---|---|---|
| 10 | N1 | 45 | 10.4 | 660 | 496 | 74 | 85.1 | 274 |
| 11 | N2 | 45 | 12.4 | 660 | 525 | 94 | 82.1 | 298 |
| 12 | N3 | 45 | 12.4 | 660 | 513 | 89 | 82.7 | 275 |
| 13 | N6 | 50 | 12.4 | 780 | 458 | 245 | 46.5 | 355 |
| 14 | N7 | 50 | 10.4 | 780 | 436 | 245 | 43.8 | 336 |
| 15 | N8 | 50 | 9.4 | 780 | 470 | 294 | 37.4 | 235 |

EXAMPLES 16 TO 21

The photoconductive recording materials of examples 16 to 21 were produced as described in Example 3 except that an α-crystal modification of compound 2 produced as described in Example 2 was used as the charge generating material and different n-CTM's were used as the CTM. The CTL layer thicknesses are given in Table 5 together with the CTM and CTM concentrations used.

The electro-optical properties of the thus obtained photoconductive recording materials were determined as described above and the results are summarized in Table 5.

TABLE 5

| Example No. | CTM | CTM conc. [wt %] | $d_{CTL}$ [μm] | λ [μm] | It = 20 mJ/m² CL [V] | RP [V] | % discharge | dark discharge in 1st 30 s [V] |
|---|---|---|---|---|---|---|---|---|
| 16 | N1 | 45 | 12.4 | 660 | 486 | 139 | 71.4 | 219 |
| 17 | N2 | 45 | 11.4 | 660 | 532 | 175 | 67.1 | 149 |
| 18 | N3 | 45 | 11.4 | 660 | 516 | 163 | 68.4 | 230 |
| 19 | N6 | 50 | 13.4 | 780 | 452 | 229 | 49.3 | 336 |
| 20 | N7 | 50 | 12.4 | 780 | 434 | 226 | 47.9 | 299 |
| 21 | N8 | 50 | 13.4 | 780 | 482 | 333 | 30.9 | 189 |

We claim:

1. An electrophotographic recording material comprising a conductive support, a photosensitive recording layer having charge generating capacity by photo-exposure and containing a photoconductive pigment selected from the group consisting of a photoconductive crystalline mono-substituted metal-free phthalocyanine compound and a mixed crystal pigment of said mono-substituted metal-free phthalocyanine compound with an unsubstituted metal-free phthalocyanine, wherein said mono-substituted metal-free phthalocyanine compound is represented by the following general formula (I):

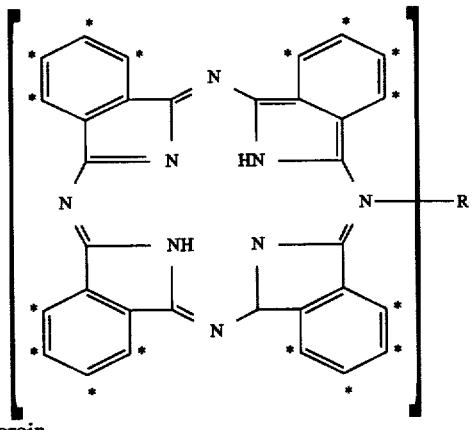

(I)

wherein

R represents a substituent selected from the group consisting of an alkyl group and an alkoxy group, said substituent being in ortho- or meta-position on a 6-membered ring in the phthalocyanine structure, the possible substitution positions being marked by asterisk (*) and an n-type charge transporting layer.

2. Electrophotographic recording material according to claim 1, wherein in said general formula (I) R is in the ortho-position and the major part by weight of said photoconductive pigment is present in the X-morphological form.

3. An electrophotographic recording material according to claim 2, wherein said mono-ortho substituted metal-free phthalocyanine pigment and said mixed crystals of said mono-ortho substituted metal-free phthalocyanine pigment with unsubstituted metal-free phthalocyanine have been obtained with their major part in X-morphological modification by the treatment of their corresponding α-morphological modification with refluxing α-methylnaphthalene.

4. Electrophotographic recording material according to claim 1, wherein in said general formula (I) R is in the meta-position and the major part by weight of said photoconductive pigment is present in the α-morphological form.

5. An electrophotographic recording material according to claim 3, wherein said mono-meta substituted metal-free phthalocyanine pigment and said mixed crystals of said mono-meta substituted metal-free phthalocyanine pigment with unsubstituted metal-free phthalocyanine have been obtained with their major part in highly crystalline α-morphological modification by the treatment of their corresponding poorly crystalline α-morphological modification with refluxing α-methylnaphthalene.

6. Electrophotographic recording material according to claim 1, wherein in said general formula (I) R is $CH_3$.

7. Electrophotographic material according to claim 1, wherein said mono-substituted metal-free phthalocyanine is present in a mixed crystal together with an unsubstituted metal-free phthalocyanine in a molar ratio range from 0.14 to 3.3.

8. Electrophotographic recording material according to claim 1, wherein said photoconductive pigment is present in a charge generating layer in the range 30 to 70% by weight with respect to the total weight of said layer.

9. Electrophotographic recording material according to claim 1, wherein the photosensitive layer is less than 30 μm thick.

10. An electrophotographic recording material according to claim 1, wherein said charge generating layer has a thickness less than 5 μm.

11. Electrophotographic recording material according to claim 1, wherein the photosensitive recording layer contains a binder being a hardened or unhardened resin.

12. Electrophotographic recording material according to claim 11, wherein the unhardened resin is selected from the group consisting of cellulose esters, acrylate resins, methacrylate resins, cyanoacrylate resins, polyvinyl chloride, copolymers of vinyl chloride, polyvinyl acetal resins, polyester resins, aromatic polyester-carbonate resins and aromatic polycarbonate resins.

13. Electrophotographic recording material according to claim 11, wherein the hardened resin is selected from the group consisting of phenoxy and epoxy resins hardened with polyisocyanates, epoxy resins hardened with polyaminoamide resins, epoxy resins hardened with amines and hydroxy-group containing polymers hardened with polyisocyanates.

14. An electrophotographic recording material according to claim 1, wherein in the recording material an adhesive layer or barrier layer is present between the photosensitive layer having charge generating capacity by photo-exposure and the support and the thickness of said barrier layer is not more than 1 micron.

15. An electrophotographic recording material according to claim 1, wherein the conductive support is made of aluminium, steel, brass or paper or resin material incorporating or being coated with a conductivity enhancing substance, the support being in the form of a foil, web or being part of a drum.

16. An electrophotographic recording process comprising the steps of:

(1) providing an electrophotographic recording material comprising a conductive support, a photosensitive recording layer having charge generating capacity by photo-exposure and containing a photoconductive pigment selected from the group consisting of photoconductive crystalline mono-substituted metal-free phthalocyanine compound and a mixed crystal pigment of said mono-substituted metal-free phthalocyanine compound with an unsubstituted metal-free phthalocyanine, wherein said mono-substituted metal-free phthalocyanine compound is represented by the following general formula (I):

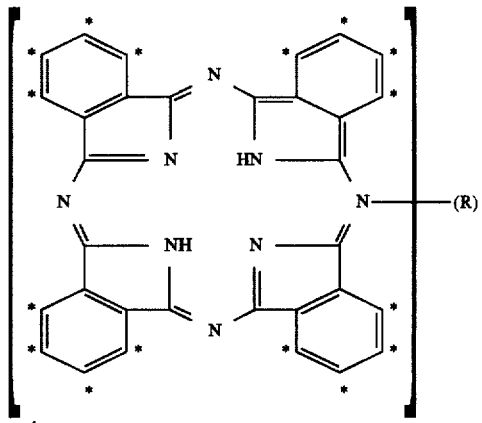

(I)

wherein:

R represents a substituent selected from the group consisting of an alkyl group and an alkoxy group, said substituent being in ortho- or meta-position on a 6-membered ring in the phthalocyanine structure, the possible substitution positions being marked by asterisk (*) and an n-type charge transporting layer;

(2) overall electrostatically charging said electrophotographic recording material on said conductive support, and (3) image-wise photo-exposing said photosensitive layer of said electrophotographic recording material thereby obtaining a latent electrostatic image.

* * * * *